US006563110B1

(12) United States Patent
Leri

(10) Patent No.: US 6,563,110 B1
(45) Date of Patent: May 13, 2003

(54) IN-LINE GAS IONIZER AND METHOD

(75) Inventor: Dennis A. Leri, Pleasant Hill, CA (US)

(73) Assignee: Ion Systems, Inc., Berkeley, CA (US)

( * ) Notice: Subject to any disclaimer, the term of this patent is extended or adjusted under 35 U.S.C. 154(b) by 0 days.

(21) Appl. No.: 09/563,776

(22) Filed: May 2, 2000

(51) Int. Cl.[7] ..... H05F 3/06

(52) U.S. Cl. ..... 250/282; 361/231; 361/213; 204/164

(58) Field of Search ..... 250/282; 361/230, 361/231, 213, 220; 204/164

(56) References Cited

U.S. PATENT DOCUMENTS

| | | | | | |
|---|---|---|---|---|---|
| 4,438,479 | A | | 3/1984 | Schwartz et al. | 361/213 |
| 4,827,371 | A | * | 5/1989 | Yost | 361/213 |
| 5,506,744 | A | * | 4/1996 | Rush et al. | 361/220 |
| 5,750,011 | A | * | 5/1998 | Ohmi et al. | 204/164 |

FOREIGN PATENT DOCUMENTS

| | | |
|---|---|---|
| GB | 769055 | 2/1957 |

* cited by examiner

*Primary Examiner*—John R. Lee
*Assistant Examiner*—Zia R. Hashmi

(74) *Attorney, Agent, or Firm*—Fenwick & West LLP

(57) ABSTRACT

A first stream of pressurized gas is directed at high toward a target area through an ionization chamber. As the high-speed, pressurized gas flows through the ionization chamber, a low-pressure region is used to draw a second stream of gas into the ionization chamber. The second stream of gas is drawn into the ionization chamber from the target area. Re-circulation of gas from the target area supplements the pressurized gas, thereby increasing the efficiency of ionization while reducing the volume of pressurized gas that must be consumed. This helps to prevent recombination while increasing the rate of flow of ionized gas to the target area. A cost-effective, safe, low-level radiation source is used to direct soft X-rays through a filtering window at the gas as it passes through the ionization chamber. Use of the filtering window physically separates the low-level radiation source from the ionization chamber and only allows soft X-rays to pass into the chamber. The filtering window is comprised of thin polymer film mounted on a silicon support grid and surrounded by a support ring, which provides an effective and safe device for filtering and dispersing the soft X-rays. Perfectly balanced amounts of positive and negative ions are produced by this type of X-ray ionization technique. No electric field, ozone, or EMI is generated, and no calibration is required. The output is particle and contaminate free with no cleaning maintenance required.

29 Claims, 4 Drawing Sheets

IN-LINE GAS IONIZER AND METHOD

FIELD OF THE INVENTION

This invention relates to the field of ionizers and specifically to an improved in-line gas ionizer. The in-line gas ionizer maintains an inherently balanced and contamination-free atmosphere, and thus suppresses electrostatic charge buildup within a target area or clean environment.

BACKGROUND OF THE INVENTION

Electrically insulated objects and ungrounded metal objects may acquire built up electrostatic charge over time, which can range up to several thousand volts. Differences in local surface charge may also develop on insulated materials. The accumulation of electrostatic charge occurs for many reasons, including movement of objects and the accompanying friction, induction or receipt of charge from other objects, and contact with electrostatically-charged surfaces.

The accumulation of electrostatic charge can have undesirable effects in some instances. For example, the manufacture of electrical components such as integrated circuits can be adversely affected by electrostatic charge. Static charge can destroy the minute conductive paths in integrated circuits and can cause dust particles and other contaminants to accumulate on the circuits.

Integrated circuits are typically manufactured through a controlled process in a clean environment, wherein equal amounts of positive and negative ions are generated in order to reduce electrostatic charge and minimize airborne contaminants. Maintaining a high level of positive and negative ions in the air which surrounds electrical components in a manufacturing environment is one of the more effective techniques for suppressing electrostatic charge. A conventional air ionizer for generating positive and negative ions typically includes two or more high voltage electrodes which are situated a certain distance away from the objects which are to be electrostatically protected. The intense electrical field generated by an electrode causes a corona discharge, which acts to disassociate air molecules into positive and negatively charged ions. Ions with the same polarity as the charged electrode are repelled and disbursed outward, producing an available ion charge current. Electrodes of both polarities are provided in order to generate equal amounts of positive and negative ions. The electrodes are typically positioned close enough to the electrical components so that the ions will be attracted to the surface charges or come in direct contact with the components. A fan is often introduced into the system in order to generate airflow across the electrodes and further disburse the ions in a stream of air toward the electrical components that are to be electrostatically protected. These ions neutralize undesirable electrostatic charge.

The conventional fan-assisted, corona type air ionizer is not always appropriate in some modern clean room applications for several reasons. Integrated circuits are manufactured in an isolated mini-environment which can be limited in space, this makes the use of a fan for ion dispersion very difficult. Furthermore, the use of a fan for ion dispersion can also cause contamination problems such as emitter point erosion and the introduction of dirty particles from the fans.

Additionally, this type of fan-assisted, high voltage electrode air ionizer generates a significant electromagnetic field. This electromagnetic field can damage the integrated circuits if the fan-assisted, high voltage electrode air ionizer is positioned too close to the target integrated circuits. Finally, when using a conventional fan-assisted, high voltage electrode air ionizer, the high voltage electrodes must be positioned equidistant from the target integrated circuits in order to provide highly concentrated, equal amounts of positive and negative ions which are able to reach the target integrated circuits. If the electrodes are not equidistant from the target integrated circuits than more ions of one polarity may reach the circuits than ions of the opposite polarity—ex. if the positive electrode is closer to the target integrated circuits then the negative electrode than more positive ions may reach the target integrated circuits than negative ions. If this occurs, this may impart a charge to the circuits, thereby damaging them. In many environments it is very difficult, if not impossible, to achieve a perfect equidistant arrangement due to obstructions or size restrictions.

U.S. Pat. No. 4,827,371 granted to Yost discloses an alternative X-ray technique for providing both positive and negative ions toward a target area in order to reduce electrostatic charge and eliminate particulates in a clean air environment. The technique disclosed in Yost ionizes pressurized gas and delivers the ionizedgas to a target area where the charge and air contaminants are to be eliminated. However, the device disclosed in the Yost patent requires the continuous use of large volumes of pressurized gas in order to operate effectively. In addition to being costly, the large volume of ionized gas in Yost's method is not efficiently managed in order to avoid recombination of the ions before the ionized gas reaches the target area. In Yost, the ionized gas is produced in high concentration in a relatively stagnant air chamber. The ions are not harvested or directed toward the target area quickly enough, resulting in ion recombination before the target area is reached. In addition, the device is cumbersome to implement and may be impractical for some applications. The present invention, as discussed below, overcomes the inherent limitations of Yost's ionizing technique.

SUMMARY OF THE INVENTION

The method and apparatus of the present invention provide a continuous flow of clean, balanced, ionized gas into a target area in order to reduce electrostatic charge build up and protect electrical components in a clean environment. The unique design of this invention allows more efficient production and delivery of ionized gas toward a target area using a relatively or particularly small device. The ionized gas is directed at a sufficiently high velocity toward the target area, thereby eliminating electrostatic charges within the area and reducing ion recombination effects found in the prior art.

In one aspect of the present invention, a stream of pressurized gas is directed through an inlet channel into an ionization chamber, where the gas is ionized. The ionized gas is further directed out of the chamber, through an outlet port, and toward a target area at a high velocity. Within the inlet channel is a removable flow-regulating device which has a central restriction or orifice through which the pressurized gas is directed. The size of the central restriction or orifice controls the speed at which the pressurized gas is directed toward the ionization chamber. Moreover, the size of the oriface also affects dispersion of the gas within the ionization chamber as it enters the chamber. Since the flow regulating device is removeable, different flow regulating devices (each having a different size central restriction or orifice) can be used to regulate and vary the speed at which gas is directed into the chamber and achieve increased dispersion of the gas as it enters the chamber. Accordingly, flow speeds of gas through the ionization chamber can be achieved which are much greater than that attributable to using pressurization alone. Further, the gas can be dispersed more broadly as it passes through the oriface of the flow-regulating device and enters the ionization chamber. These features produce higher ionization yields and reduce ion recombination.

Another aspect of the invention allows previously ionized gas to be recirculated through the ionization chamber in order to supplement the pressurized gas which is directed into the ionization chamber through the inlet channel. Recirculation of previously ionized gas through the ionization chamber increase the total volume of ionized gas produced without requiring the exclusive use of expensive pressurized gas. As the pressurized gas is forced at a high velocity through the flow-regulating device and into the ionization chamber, a low-pressure area is created within the chamber. The size of the central restriction or orifice in the flow-regulating device controls the intensity of this low-pressure area. The low-pressure area is used to draw previously ionized gas from the target area through a return line, and back into the ionization chamber through a second inlet port, where it is once again ionized and mixes with the pressurized gas. An in-line filter may be used at the second inlet port to filter out any airborne contaminants, which may have been introduced into the recirculated gas drawn from the target area. The use of re-circulated gas increases the ionization effect of the in-line gas ionizer while reducing the volume of expensive pressurized gas that must be used.

In a further aspect, the present invention includes a miniaturized low level radiation source, such as a soft X-ray source, which ionizes the combined pressurized and recirculated gases as they flow through the ionization chamber. The miniaturized low level radiation source is compact and preferably as small as 1.5"×3"×4" in size. The low-level radiation source emits soft X-rays into the ionization chamber through a transparent window. The transparent window is comprised of a thin polymer film. Use of a low level radiation source, such as a soft X-ray source, is less expensive and easier to shield. Moreover, soft X-rays will not penetrate the human skin or cause any health risks. An integral transparent window and seal arrangement allows the soft x-rays to pass into the ionization chamber while the device and outside air are isolated from the clean gas flow path. A leakproof seal is preferably used to secure the transparent window for optimum contamination control.

DETAILED DESCRIPTION OF THE PREFERRED EMBODIMENTS

Figure 1:
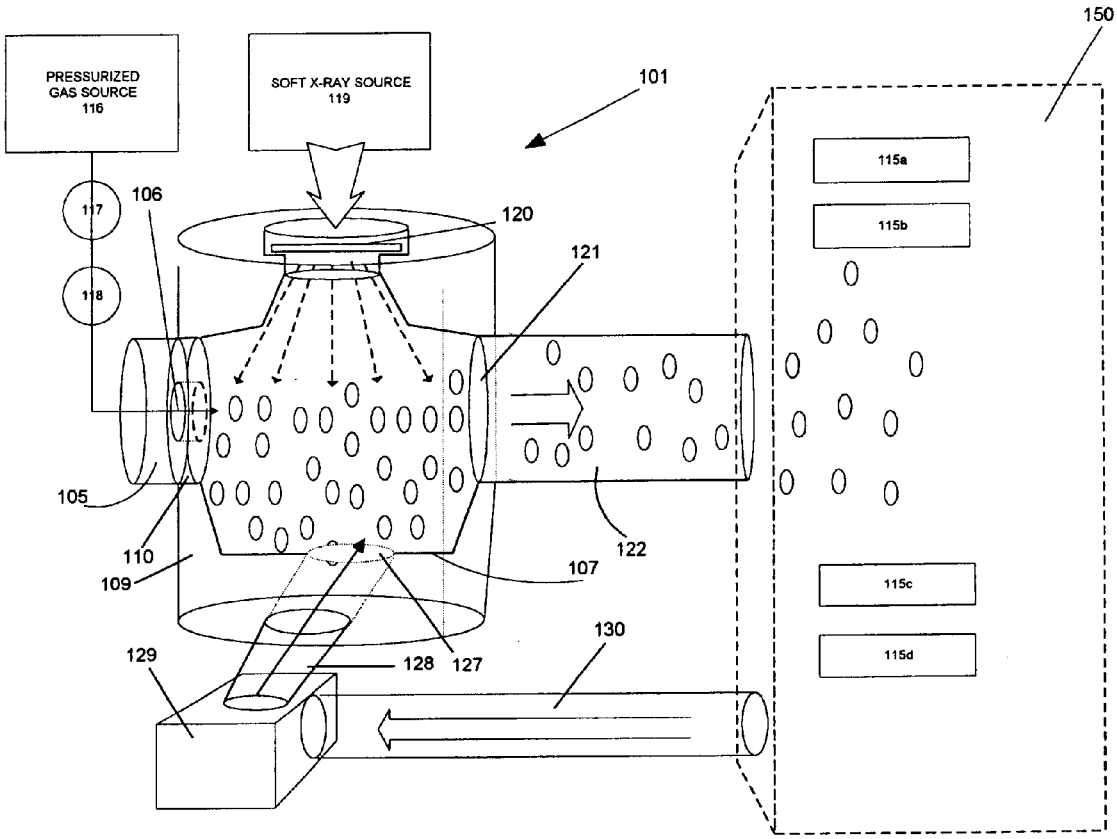
FIG. 1 is a perspective view of an apparatus for providing ionized gas in order to suppress electrostatic buildup in accordance with a preferred embodiment of the present invention.

Referring to FIG. 1, an in-line gas ionization device (101) is shown, in accordance with a preferred embodiment of the present invention. The in-line gas ionization device of the present invention provides ionized gas to a target area or isolation box in order to suppress electrostatic buildup. The in-line gas ionization device (101), as shown, is coupled to an isolation box (150), which may be any type of storage for integrated circuits and/or other electronic components (115*a–d*). It is understood that the in-line gas ionization device does not necessarily have to be coupled to an isolation box. It may, instead, operate as a stand alone device in a clean air environment. The in-line ionization device (101) is used to generate ions into a clean air environment or isolation box in order to protect objects, such as integrated circuits, that may be susceptible to electrostatic charge damage.

Pressurized gas flows into the in-line ionization device from a pressurized gas source (116). The gas flows through a first inlet port (105) containing a flow-regulating device (110) an into an ionization chamber 107. The flow-regulating device (110) contains a central restriction or oriface 106 which controls the velocity at which the pressurized gas flows into the ionization chamber. The size of the central restriction or oriface 106 also affects the dispersion of the gas as it enters into the ionization chamber 107. In a preferred embodiment, the flow-regulating device (110) is removeable and can be replaced with alternate flow-regulating devices, each such device having a different size central restriction or orifice 106, in order to control the velocity and dispersion of the pressurized gas into the ionization chamber 107, as desired.

Gas is passed through the flow-regulating device 110 into the ionizing chamber (107), which is preferably capable of holding volumes of air/gas on the order of 0.001 to 0.010 liters. As the pressurized gas flows into the ionization chamber 107, a low pressure area or suction force is created within the chamber. As explained earlier, the flow-regulating device 110 is removeable and any one of several flow-regulating devices can be used to achieve various gas velocities inside the chamber (107). Accordingly, a larger pressure area with a greater intensity or suction force is created when a flow-regulating device having a smaller orifice is used. The orifice size can therefore be optimized for ionization performance, as target areas vary.

The ionization chamber (107) is preferably cylindrical in shape, although alternative shapes and bodies are possible. The chamber (107) is cased in an ionization housing (109). The housing (109) is preferably of sufficient thickness and containment design to prevent leakage of radiation from the chamber (107). It is also preferable for the ionization housing (109) to be made from ultra-clean, high-grade stainless steel for ultra clean applications.

Once the high velocity gas enters into the ionization chamber (107), it is ionized using a low level radiation source. In a preferred embodiment, the low level radiation source is a miniaturized soft X-ray source (119) which generates soft X-rays. In a preferred embodiment, the low level radiation source is a miniaturized soft X-ray source (119) which rests above the ionization housing (109). Soft X-rays have a wavelength between 0.13 and 0.41 nanometers and energy levels between 3 k and 9.5 k electron volts. The soft X-rays are injected into the ionization chamber (107) through a transparent window (120). Ideally, the transparent window is constructed of thin polymer film (comprised of a boron hydride coating integrated into a 0.8 micron Kapton polyimide film). Alternative polymers may also be substituted such as polyester, mylar, polypropylene, teflon, polycarbonate, and polyamide. The polymer film is supported by a micro-machined silicon grid for additional strength and durability. The ionized gas flows out of the ionization chamber (107) through an outlet port (121) and outlet channel (122). The ionized gas is directed toward a clean air environment or isolation box (150). Since the central restriction or oriface 106 also affects the dispersion of the gas as it enters the ionization chamber, alternate flow regulating devices 110 may be used in order to optimize the dispersion of the gas and increase ionization efficiency.

In a preferred embodiment, the pressurized gas used for the ionization process should be an oxygen-free supply, or a mixture of gases that is generally non-reactive. The gas should also exhibit a high susceptibility to ionization when exposed to low levels of radiation such as those in soft X-rays. Nitrogen, for example, is an alternative to clean dry air that exhibits desirable properties for purposes of generating ions when exposed to low levels of radiation.

Also shown in FIG. 1 is a second inlet channel (128) that opens through a second inlet port (127) into the bottom of the ionization chamber (107). The second inlet channel (128) is located at the bottom of the housing (109). As the pressurized gas flows into the ionization chamber (107), a low-pressure area is created at the bottom of the chamber (107). The smaller the central restriction or orifice (106) in the flow regulating device 110, the larger the low pressure area which is created. This low pressure area is used to draw supplemental gas into the chamber. This supplemental gas is then combined with pressurized gas, therein producing a combined gas. The combined gas is ionized and flows out of the ionization chamber (107) through the outlet port (121) and outlet channel (122). The combined ionized gas is directed toward a clean air environment or isolation box (150). In a preferred embodiment, the second inlet port (127) is positioned directly below the transparent window (120) so that the supplemental gas that is drawn in is also ionized as it passes through the ionization chamber (107).

In a preferred embodiment, the supplemental gas drawn in by the low pressure area comes directly from the clean air environment or isolation box (150) where the combined ionized gas is released. In this way, the supplemental gas drawn in by the low pressure area is recycled gas. The recycled gas is fed through the second inlet channel (128) using a recycling channel (130), which is located between the isolation box (110) or target area, and the ionization housing (109). The recycling channel (130) preferably includes an in-line filter (129) that filters out any airborne contaminants which may have been introduced into the gas in the isolation box (110) or target area.

The re-circulation of gas from the isolation box (110) or target area supplements the use of pressurized gas and increases the ionization effects of the soft X-rays. By using recycled gas, a larger volume of gas may be ionized and dispensed without having to use more pressurized gas. The use of recycled gas reduces the expense of using pressurized gas while providing increased volumes of ionized gas. Accordingly, the use of recycled gas is beneficial when supply or consumption of pressurized gas must be limited (as in cases where the gas is clean dry air or nitrogen). In environments where gas amounts are controlled, this method also allows the gas ratios or chemistry of the atmosphere to be minimally disrupted.

The following chart provides some statistical information on general performance characteristics of the preferred embodiment.

| Pressure of Inlet Gas | Size of Orifice in Flow Regulating device | Flow Rate of Pressurized Gas into Ionization Chamber | Flow Rate of Recycled Air/Gas into the Ionization Chamber | Total Flow Rate of Combined Ionized Gas out of the Ionization Chamber |
|---|---|---|---|---|
| 15 psi | 0.032" ID | 12 Liters/Min | 16 Liters/Min | 28 Liters/Min |
| 10 psi | 0.032" ID | 10 Liters/Min | 14 Liters/Min | 23 Liters/Min |
| 5 psi | 0.032" ID | 7 Liters/Min | 10 Liters/Min | 16 Liters/Min |

Figure 2A:
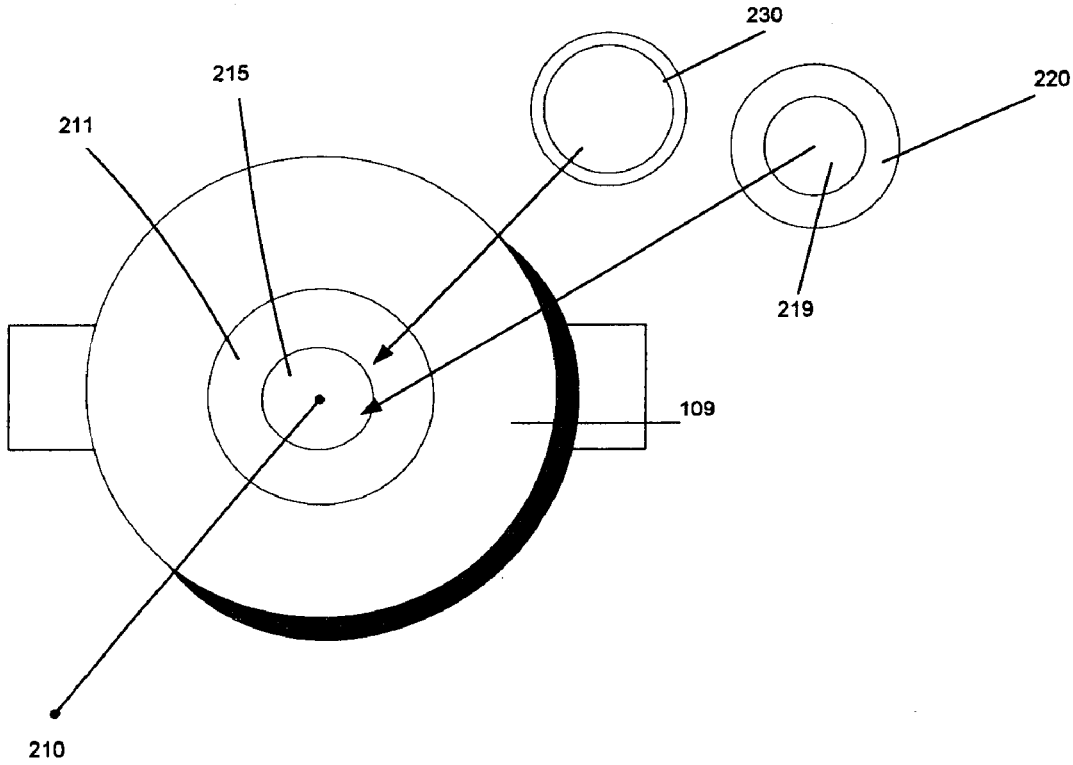
FIG. 2*a* is an overhead view of an apparatus for providing ionized gas in order to suppress electrostatic buildup in accordance with a preferred embodiment of the present invention.

FIG. 2*a* illustrates an overhead view of the in-line ionization device. The ionization housing (109) has a central axis (210). A small cylindrical cavity (211) is disposed within the interior top portion of the ionization housing (109). A small annular opening (215) is located at the bottom of the cylindrical cavity (211), in the ionization housing (109). The transparent window 120 fits in the cylindrical cavity such that the polymer film covers the small annular opening. The cylindrical cavity (211) houses the transparent window (120) through which the soft X-rays pass as they are injected into the ionization chamber (107 in FIG. 1). The transparent window (120) is a self-contained, removable unit, and is implemented as a circular shape that fits snugly within the cylindrical cavity (211). The transparent window (120), is comprised of a thin polymer film (219) that is mounted, sealed and braced by a support ring (220) which is ideally made of high-grade stainless steel.

Figure 2B:
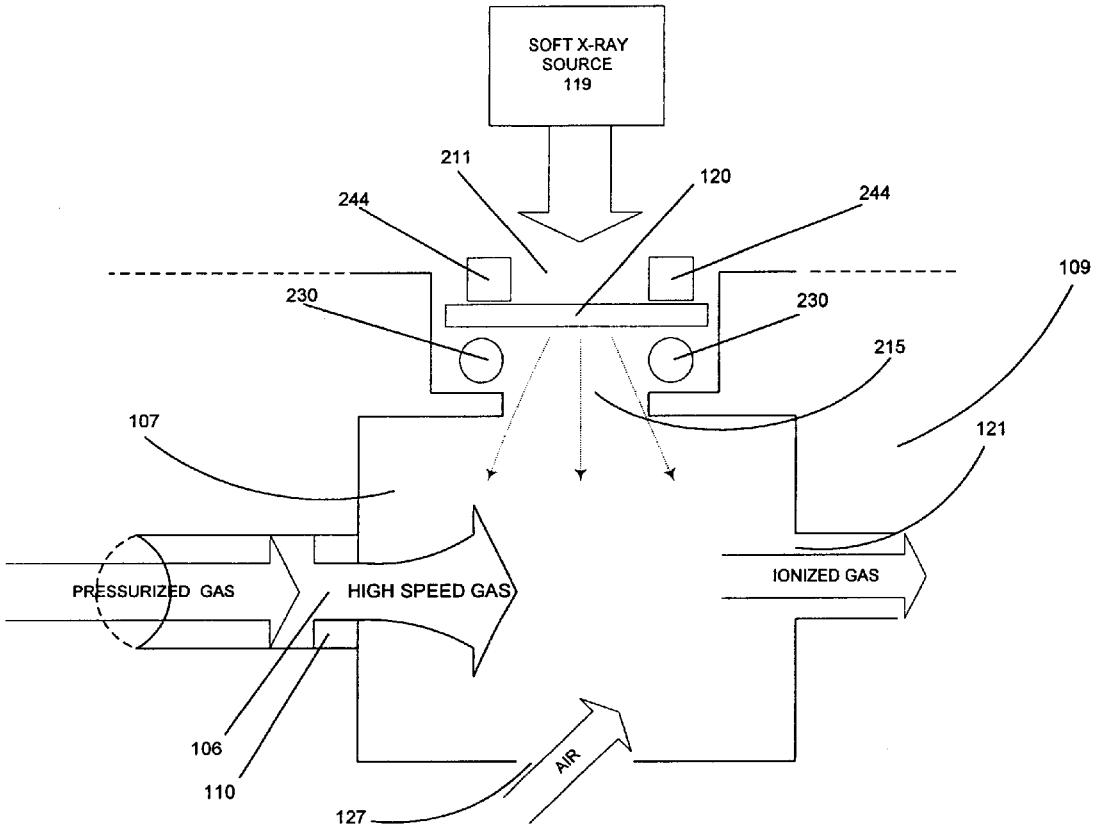
FIG. 2*b* is a cross sectional view of an apparatus for providing ionized gas in order to suppress electrostatic buildup in accordance with a preferred embodiment of the present invention.

A cross-sectional view of the in-line ionization device is shown in FIG. 2*b*. A soft X-ray source (119) is disposed above the ionization housing (109), directly over the transparent window (120). A rubberized O-ring (230) may be used for sealing the transparent window against the small cylindrical cavity (211) with a retaining nut 244. The retaining nut 244 has a center port which allows the soft X-rays to pass through the retaining nut, the thin polymer film (219) and the small annular opening (215) into the ionization chamber (107). The retaining nut (244) seats the transparent window (120) in the small cylindrical cavity (211) compressing the O-ring and preferably producing a vacuum seal for maintaining gas purity.

FIG. 2*b* also illustrates the flow of pressurized gas entering the ionization chamber (107). As shown, pressurized gas passes through a first inlet port (105) and the central restriction or orifice (106) of the flow-regulating device (110),at high velocity into the ionization chamber (107). FIG. 2*b* also illustrates the flow of the supplemental gas into the ionization chamber (107) through the second inlet port (127). As explained above, this supplemental gas is drawn into the ionization chamber (107) by a low-pressure area created by the velocity of the pressurized gas flow into the chamber (107) through the central restriction or orifice (106). The supplemental gas is recycled gas which is drawn into the chamber (107) through the second inlet port (127) from a line or tubing that is connected to the isolation box or target area.

Finally, FIG. 2*b* further shows the flow of the combined ionized gas out of the ionization chamber (107) through the outlet port (121). The second inlet port (127) is positioned directly below the transparent window (120), so that recycled gas drawn into the chamber (107) combines with the pressurized gas. The combined gas is ionized by the soft X-rays which are directed into the ionization chamber (107) through the transparent window (120). The combined ionized gas flows out of the chamber (107) through the outlet port (121).

Figure 3:
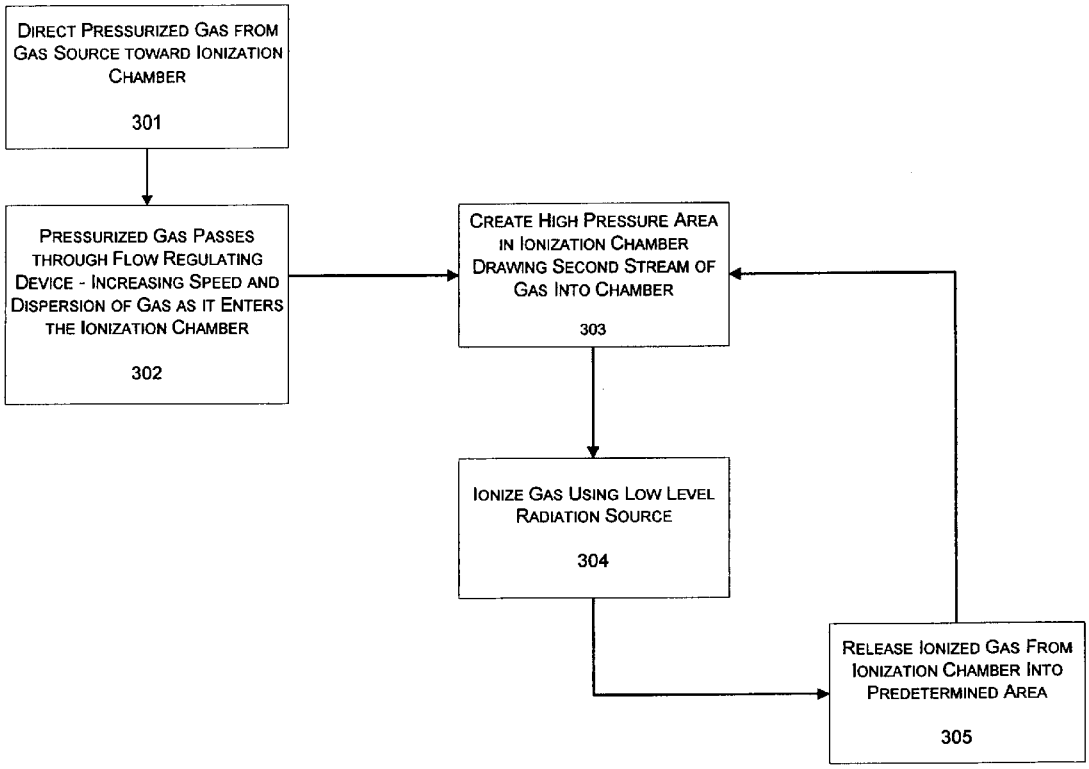
FIG. 3 is a flowchart illustrating the various steps for providing ionized gas in order to suppress electrostatic buildup in accordance with a preferred embodiment of the present invention.

FIG. 3 illustrates a process flow diagram that shows the sequence for providing ionized gas to a target area in accordance with a preferred embodiment of the present invention. First, pressurized gas is directed from a gas source toward the ionization chamber (301) through a first inlet port. Second, the gas flows through a flow-control regulating device, which has been selectively disposed within the first inlet port, in order to increase the velocity and dispersion of the gas into the ionization chamber (302). As explained earlier, the gas is directed through the ionization chamber at a sufficiently high velocity and pressure in order to create a low-pressure area within the ionization chamber. This is accomplished by selecting a flow-regulating device with a central restriction or oriface through which the speed of the pressurized gas increases as it passes into the ionization chamber. The size of the central restriction or oriface in the flow-regulating device also effects the dispersion of the gas as it enters the chamber. Accordingly, any one of several different flow-regulating devices, each having a different sized central restriction or orifice, may be used to adjust the speed and dispersion at which pressurized gas flows through the ionization chamber.

As the pressurized gas flows into the ionization chamber, a low-pressure region is created which draws a second or supplemental stream of gas into the chamber through a recycling port (303). The second or supplemental stream of gas is preferably drawn from the target area and is filtered for air contaminants as it is re-enters the chamber. In this way, a portion of the ionized gas previously released into the target area is re-circulated or recycled through the ionization chamber. This re-circulation of gas supplements the use of pressurized gas and increases effective ionization. By using recycled gas, a large volume of gas may be ionized and dispensed without having to use a large volume of pressurized gas from the gas source. This method is very cost efficient. For example, volumes of ionized gas up to 30 standard liters per minute can be dispensed while only using about 15 standard liters per minute of pressurized gas.

As the combination of pressurized gas and recycled gas flow through the ionization chamber, the combined gas is ionized using low-level radiation, thereby producing a combined ionized gas (304). In a preferred embodiment, this low-level radiation source is a soft X-ray source. The soft X-rays are directed into the ionization chamber through a thin transparent window, ionizing the combined gas. The thin transparent window is preferably comprised of a thin polymer film (comprised of a boron hydride coating integrated into a 0.8 micron Kapton polyimide film). Alternative polymers may also be substituted such as polyester, mylar, polypropylene, teflon, polycarbonate, and polyamide. The polymer film is supported by a micro-machined silicon grid for additional strength and durability.

Finally, the ionized gas is released from the ionization chamber into the predetermined region through an outlet channel (305).

The above description is included to illustrate the operation of the preferred embodiments and is not meant to limit the scope of the invention. The scope of the invention is to be limited only by the following claims. From the above discussion, variations are possible, encompassed by the spirit and scope of the present invention.

What is claimed is:

1. A method for providing a continuous flow of ionized gas to a target area, said method comprising the steps for:

directing a first stream of pressurized gas toward the target area through an enclosed ionizing chamber at a desired speed to create a low pressure area in the enclosed ionizing chamber;

drawing a second stream of gas into the enclosed ionizing chamber in response to the low pressure area created in the enclosed ionizing chamber to form a combined stream of gas;

supplying ionizing radiation into the ionizing chamber to ionize the combined stream of gas flowing through the enclosed chamber toward the target area; and channeling the ionized combined stream of gas from the enclosed ionizing chamber into the target area.

2. The method of claim 1, wherein the step for directing a first stream of pressurized gas includes the additional steps for:

directing pressurized gas from a pressurized gas source into an inlet channel coupled to and directed toward the ionizing chamber; and regulating the flow of pressurized gas within the inlet channel in order to adjust the speed at which the pressurized gas flows through the enclosed ionizing chamber.

3. The method of claim 2, wherein the step of regulating the flow of pressurized gas comprises the step for:

determining a desired high flow velocity of the pressurized gas into the ionization chamber;

selecting the flow regulating device from a plurality of flow regulating devices as a function of the desired high flow velocity, each of the plurality of flow-regulating devices having a different size orifice for flow of pressurized gas therethrough; and disposing the selected flow-regulating device within the inlet channel in order to adjust the speed at which the pressurized gas flows through the enclosed ionizing chamber.

4. The method of claim 1, wherein supplying ionizing radiation into the ionizing chamber includes directing soft X-rays at the combined stream of gas flowing through the ionizing chamber.

5. The method of claim 1, wherein the second stream of gas is drawn back into the enclosed ionizing chamber from the target area to recycle the ionized gas previously channeled into the target area.

6. A method for providing a continuous flow of ionized gas to a target area, said method comprising the steps for:

directing a stream of pressurized gas from a pressurized gas source through an inlet channel toward an enclosed ionizing chamber; and providing a flow-regulating device within the inlet channel to adjust the speed at which the pressurized gas flows into the ionizing chamber and to create a low pressure area in the enclosed ionizing chamber.

7. The method of claim 6 comprising the further step for drawing a second stream of gas into the enclosed ionizing chamber in response to the low pressure area to form a combined stream of gas.

8. The method of claim 7, further comprising the steps for:

supplying ionizing radiation into the enclosed ionizing chamber to ionize the combined stream of gas within the enclosed ionizing chamber;

and channeling the ionized combined stream of gas from the enclosed ionizing chamber into the target area.

9. The method of claim 6, wherein the step for providing a flow regulating device further comprises the step for:

determining a desired high flow velocity of the pressurized gas into the ionization chamber;

selecting the flow regulating device from a plurality of flow regulating devices as a function of the desired high flow velocity, each of the plurality of flow-regulating devices having a different size orifice for flow of pressurized gas therethrough; and disposing the selected flow-regulating device within the inlet channel in order to adjust the speed at which the pressurized gas flows through the enclosed ionizing chamber.

10. The method of claim 8, wherein supplying ionizing radiation into the enclosed ionizing chamber includes directing soft X-rays at the combined stream of gas flowing through the ionizing chamber.

11. The method of claim 7, wherein the second stream of gas is drawn back into the enclosed ionizing chamber from the target area to recycle the ionized gas previously channeled into the target area.

12. An apparatus for providing ionized gas to a target area the apparatus comprising:

an enclosed ionization chamber including a radiation-transmissive window;

a first inlet channel coupled to the enclosed ionization chamber for pressurized gas at a high velocity into the ionization chamber to form a low-pressure region within the ionization chamber;

a radiation source disposed with respect to the window for supplying radiation therethrough to ionize the gas flowing through the ionization chamber; and an outlet channel coupled to the ionization chamber for conveying ionized gas therefrom to the target area.

13. The apparatus of claim 12, further comprising a second inlet channel coupled to the ionization chamber at a region thereof in which low pressure is formed for drawing gas from the target area into the ionization chamber in response to the low-pressure region formed in the ionization chamber.

14. The apparatus of claim 12, further comprising a flow-regulating device disposed within the first inlet channel to control the flow velocity of pressurized gas into the ionizing chamber to alter the pressure associated with the low pressure area.

15. The apparatus of claim 14 in which the flow-regulating device disposed within the first inlet channel is removable and is selected from a plurality of flow-regulating devices having orifices of different sizes for altering a parameter of gas flow therethrough into the ionization chamber.

16. The apparatus of claim 12 in which the radiation source is disposed to direct radiation through the window and into the enclosed ionization chamber for ionizing pressurized gas therein.

17. The apparatus of claim 16 wherein the radiation source includes a source of soft X-rays.

18. The apparatus of claim 13 further comprising:

a pressurized gas source;

a flow-control valve coupled between the pressurized gas source and the first inlet channel for supplying the pressurized gas at a selected flow rate through the enclosed ionization chamber sufficient to form the low pressure region near the second inlet channel.

19. The apparatus of claim 13, further comprising a filter disposed in the second inlet channel for filtering out airborne contaminants present in the gas drawn into the ionization chamber through the second inlet channel.

20. The apparatus of claim 12, wherein the ionization chamber is made from a radiation-absorbing, leak proof material.

21. The apparatus of claim 20, wherein the radiation-absorbing, leak proof material includes electropolished stainless steel.

22. The apparatus of claim 12, wherein the ionization chamber has a volume not greater than approximately 0.01 liters.

23. The apparatus of claim 12, wherein the ionization chamber is cylindrical in shape.

24. The apparatus of claim 12, wherein the window comprises polymer film supported by a silicon grid.

25. The apparatus of claim 24, wherein the polymer film includes a boron hydride coating integrated with a polyimide film.

26. A method for providing a continuous flow of ionized gas to a target area, said method comprising the steps for:

directing a first stream of pressurized gas toward the target area through an enclosed ionizing chamber in which gas is substantially evenly dispersed;

supplying ionizing radiation into the ionizing chamber to ionize the dispersed gas flowing through the enclosed chamber toward the target area; and channeling the ionized gas from the enclosed ionizing chamber into the target area.

27. The method of claim 26, wherein the step for directing a first stream of pressurized gas further includes the steps for:

passing the pressurized gas through an inlet channel coupled to the ionizing chamber; and disposing a device within the inlet channel to disperse the gas within the ionization chamber.

28. The method of claim 27, wherein the step for disposing a device further comprises the steps for:

determining a desired dispersion of the pressurized gas within the ionization chamber;

selecting the device from a plurality of devices as a function of the desired dispersion, each of the plurality of devices having a different orifice for flow of pressurized gas therethrough; and disposing the selected device within the inlet channel in order to affect the desired dispersion of the pressurized gas flowing through the enclosed ionizing chamber.

29. The method of claim 26, wherein supplying ionizing radiation into the ionizing chamber to ionize the dispersed gas includes directing soft X-rays at the dispersed gas flowing through the ionizing chamber.

* * * * *